US010429769B2

(12) United States Patent
Gould, II et al.

(10) Patent No.: US 10,429,769 B2
(45) **Date of Patent: *Oct. 1, 2019**

(54) SKEW ADJUSTMENT MECHANISM FOR A ROLLER OF AN INTERMEDIATE TRANSFER MEMBER

(71) Applicant: LEXMARK INTERNATIONAL, INC., Lexington, KY (US)

(72) Inventors: Bartley Charles Gould, II, Lexington, KY (US); Kerry Leland Embry, New City, NY (US); James Philip Harden, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/967,958

(22) Filed: May 1, 2018

(65) Prior Publication Data

US 2018/0246442 A1 Aug. 30, 2018

Related U.S. Application Data

(63) Continuation of application No. 15/420,519, filed on Jan. 31, 2017, now Pat. No. 10,001,730.

(51) Int. Cl.
*G03G 15/16* (2006.01)

(52) U.S. Cl.
CPC ..... *G03G 15/1615* (2013.01); *G03G 15/161* (2013.01)

(58) Field of Classification Search
None
See application file for complete search history.

(56) References Cited

U.S. PATENT DOCUMENTS 10,001,730 B1 * 6/2018 Gould, II ..... G03G 15/161

* cited by examiner

*Primary Examiner* — Clayton E. LaBalle
*Assistant Examiner* — Jas A Sanghera

(57) ABSTRACT

An image transfer assembly includes a transfer belt formed as an endless loop around a backup roll and a tension roll. A tensioning arm is movably mounted on a side of a frame and operatively connects to an axial end of the tension roll such that the arm and axial end of the tension roll moves together relative to the frame. A translating member slidably mounted about the axial end of the tension roll is movable in an axial direction. A cam disposed below the translating member has an angled cam surface in contact with a portion of the translating member such that as the translating member moves in the axial direction, the translating member moves along the angled cam surface changing an elevation of the arm and axial end of the tension roll and changing an amount of skew of the tension roll relative to the frame.

20 Claims, 5 Drawing Sheets

SKEW ADJUSTMENT MECHANISM FOR A ROLLER OF AN INTERMEDIATE TRANSFER MEMBER

This application claims priority as a continuation application of U.S. patent application Ser. No. 15/420,519, Filed Jan. 31, 2017, having the same title.

FIELD OF THE INVENTION

The present disclosure relates to an intermediate transfer member (ITM) in an imaging device which limits the lateral movement of the ITM belt. It relates further to a positioning mechanism for a roller of the ITM that provides passive roller skew adjustment in response to ITM belt tracking.

BACKGROUND

When an ITM belt is driven around a system of rollers in an electrophotographic (EP) printer, such as a laser printer, lateral motion of the ITM belt can occur in addition to the motion in the driven direction (i.e., in the process direction). Several component dimensions directly affect ITM belt tracking, such as roll cylindricity, roll alignment, and tension variations. Historically, these dimensions are held to tolerances at the extreme of manufacturability in order to prevent an accumulation of additive effects that result in high ITM belt stress. Ultimately, it is the cyclic fatigue of the ITM belt material that continues to be a primary failure mode for the ITM. The use of a rib to constrain ITM belt tracking improved overall robustness, but at the cost of additional components and sensitivity to rib application tolerances. Reinforcement tape also reduced fatigue failure rate, but at the cost of overall ITM width and cleaner seal difficulties. Each improvement to fatigue life has attempted to make the ITM belt more resistant to stresses induced by constraining the ITM belt in the ITM, but with limited success.

SUMMARY

The foregoing and other are solved by a positioning mechanism for a roller of an ITM that provides passive roller skew adjustment in response to belt tracking. In one embodiment, an image transfer assembly includes a backup roll and a tension roll rotatable about respective axes of rotation within a frame. A transfer belt is formed as an endless loop around the backup roll and the tension roll such that rotation of at least one of the backup roll and the tension roll causes the transfer belt to rotate. A tensioning arm is movably mounted on a side of the frame and operatively connects to an axial end of the tension roll such that movement of the tensioning arm relative to the frame moves the axial end of the tension roll relative to the frame. A translating member slidably mounted about the axial end of the tension roll between the tensioning arm and the tension roll is movable in an axial direction. A cam disposed on the side of the frame and below the translating member has an angled cam surface in contact with a portion of the translating member. The angled cam surface has a variable height in the axial direction such that as the translating member moves in the axial direction, the translating member moves along the angled cam surface changing an elevation of the arm and the axial end of the tension roll relative to the frame thereby changing an amount of skew of the tension roll relative to the frame.

In other embodiments, an edge of the transfer belt engages an edge guide of the translating member when the transfer belt moves laterally towards the side of the frame pushing the translating member down the angled cam surface and decreasing the elevation of the axial end relative to the frame. When the transfer belt laterally moves away from the side of the frame, a biasing member disposed between the tensioning arm and translating member urges the translating member to follow with the direction of motion of the transfer belt and move up the angled cam surface thereby increasing the elevation of the axial end relative to the frame. The translating member passively moves along the angled cam surface to change the amount of skew of the tension roll until a state of equilibrium is achieved in which the translating member is approximately stationary relative to the angled cam surface and the amount of skew of the tension roll reduces the lateral movement of the transfer belt. These and other embodiments are described below.

DETAILED DESCRIPTION OF THE ILLUSTRATED EMBODIMENTS

Figure 1:
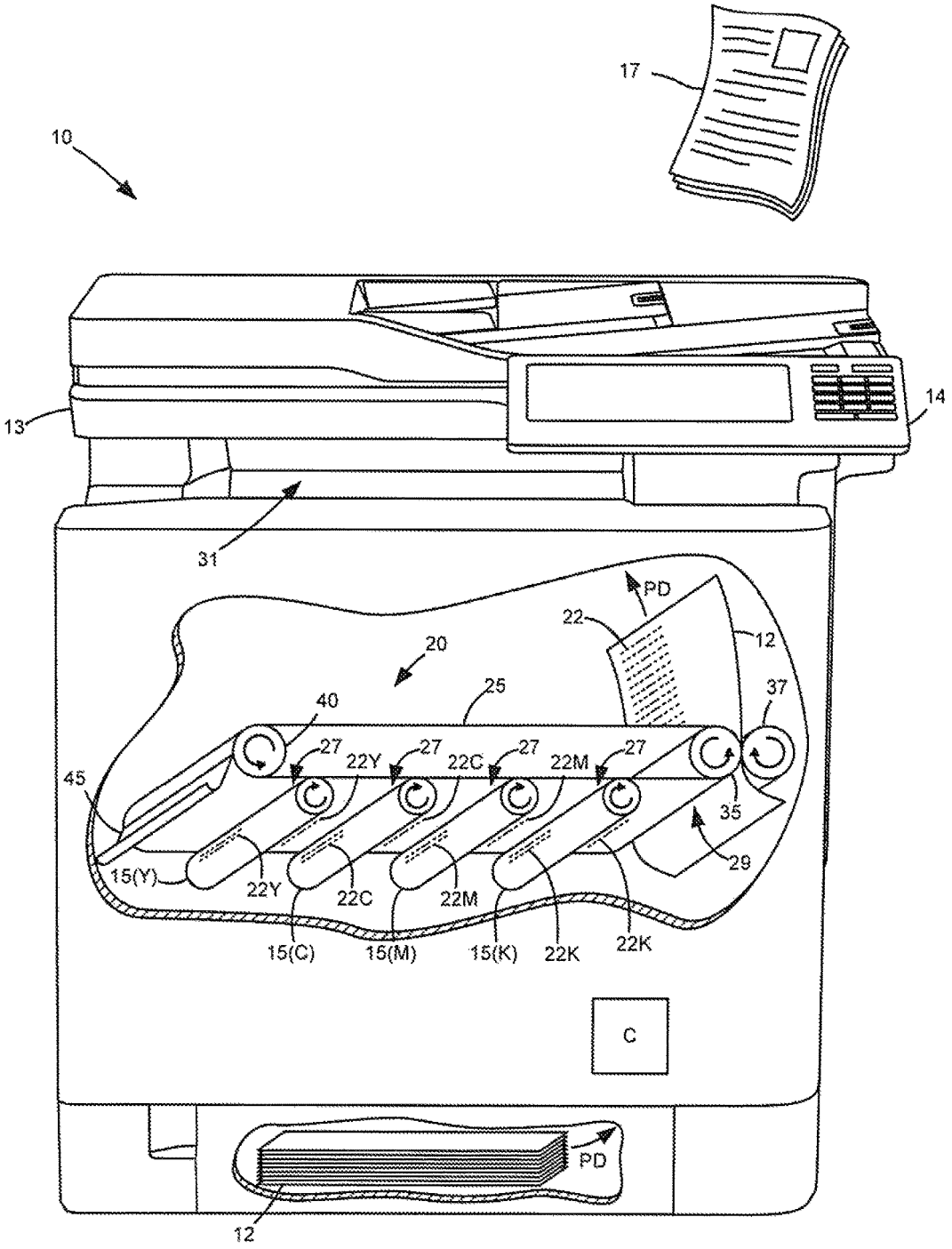
FIG. 1 is a diagrammatic view of an imaging device, including cutaway with a diagrammatic view of an image transfer assembly.

With reference to FIG. 1, a color electrophotographic imaging device 10 is shown according to an example embodiment. Imaging device 10 is used for printing images on media 12. Image data of the image to be printed on the media is supplied to imaging device 10 from a variety of sources such as a computer, laptop, mobile device, scanner, or like computing device. The sources directly or indirectly communicate with imaging device 10 via wired and/or wireless connection. A controller (C), such as an ASIC(s), circuit(s), microprocessor(s), etc., receives the image data and controls hardware of imaging device 10 to convert the image data to printed data on the sheets of media 12.

For color imaging device 10, a plurality of photoconductive (PC) drums 15 for each color plane (Y), (C), (M) and (K) are disposed along an intermediate transfer member (ITM) 20. During use, controller (C) controls one or more laser or light sources (not shown) to selectively discharge areas of each PC drum 15 to create a latent image of the image data thereon. Toner particles are applied to the latent image to create a toned image 22 on the PC drum 15. The toned image 22 from each PC drum 15 is transferred to a transfer belt 25 of the ITM 20 at a first transfer area 27, and then transported by the rotating transfer belt 25 to a second transfer area 29 at which toned image 22 is transferred to a media sheet 12 travelling in a process direction PD. The media sheet 12 with the toned image 22 passes through a fuser (not shown) which applies heat and pressure to the media sheet 12 in order to fuse the toned image thereto. Ultimately, the media sheet 12 is either deposited into an output media area 31 or enters a duplex media path for transport to the second transfer area 29 for imaging on the other side of the media sheet 12.

In a further embodiment, transfer belt 25 is formed as an endless loop around a backup roll 35 and a tension roll 40 such that rotation of at least one of backup roll 35 and tension roll 40 causes transfer belt 25 to rotate as indicated by their direction arrows. Backup roll 35 is disposed at one end of ITM 20 and forms a transfer nip with a transfer roll 37 at the second transfer area 29 while tension roll 40 is disposed at the opposite end of ITM 20 and provides suitable tension to transfer belt 25. Tension roll 40 also provides a surface against which a cleaner blade 45 of a cleaning unit indirectly contacts to remove residual toner from the transfer belt 25 prior to a subsequent imaging operation. The cleaning unit may include an interior space for collecting the residual toner that is removed from transfer belt 25 by cleaner blade 45, and an auger (not shown) for moving the collected residual toner to a waste toner container (not shown) in imaging device 10.

Figure 2:
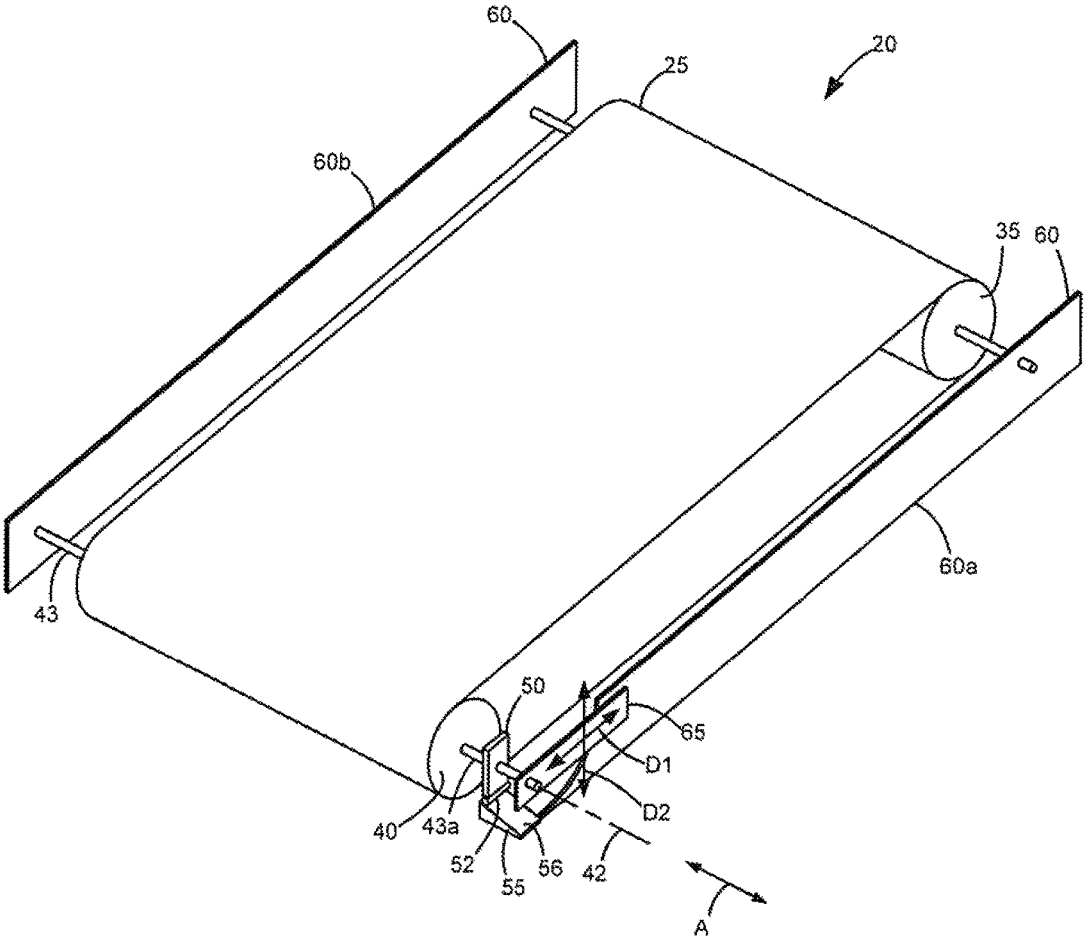
FIG. 2 is a diagrammatic view of the image transfer assembly with a passive adjustment mechanism for a tension roll.

In order to minimize or substantially reduce bias related stresses on transfer belt 25 induced by belt tracking, a positioning mechanism for tension roll 40 provides the ability for the tension roll 40 to self-adjust with lateral movement of the transfer belt 25 without any user intervention. In FIG. 2, a belt follower 50 disposed about an axial end of tension roll 40 and riding on an angled cam surface 56 provides this functionality. Belt follower 50 alters skew of the tension roll by passively adjusting the elevation of the axial end of tension roll 40 as belt follower 50 moves along the angled cam surface 56 in the same direction as the direction of lateral movement of transfer belt 25.

With further reference to FIG. 2, tension roll 40 is rotatable about an axis of rotation 42 within a frame 60 between opposite sides 60*a*, 60*b* thereof. In the example shown, tension roll 40 includes a shaft 43 defining the axis of rotation 42 and having one of its axial end 43*a* connected to a tensioning arm 65. Tensioning arm 65 is moveably mounted on side 60*a* of frame 60 such that tensioning arm 65, and with it the axial end 43*a* of tension roll 40, is movable along directions D1 and D2 relative to frame 60. An example mounting configuration for tensioning arm 65 includes the use of slots which engage with corresponding posts extending from side 60*a* of frame 60 to allow tensioning arm 65 to be translatable in directions D1 and D2. Of course, other mounting configurations are possible. The use of translatable tensioning arm 65 results in tension roll 40 "floating" relative to frame 60 and the tension of transfer belt 25 to be adjustable. In other embodiments, a similar tensioning arm may be arranged in the same manner on the other side 60*b* of frame 60.

The positioning mechanism includes belt follower 50 which is a translating member mounted about the axial end 43*a* of tension roll 40 and movable in an axial direction thereof parallel to the axis of rotation 42. A portion of belt follower 50 is in contact with the angled cam surface 56 of a cam 55 attached to side 60*a* of frame 60. The angled cam surface 56 has a variable height in the axial direction A such that as belt follower 50 axially moves, belt follower 50 moves along the angled cam surface 56 causing the axial end 43*a* of tension roll 40 and tensioning arm 65 to move in direction D2. To reduce frictional resistance at contact points, such portion of belt follower 50 contacting the angled cam surface 56 is made from materials having relatively small coefficient of friction. In one example, belt follower 50 includes one or more roller pins 52 riding along the angled cam surface 56.

Movement of belt follower 50 in the axial direction and along the angled cam surface 56 changes the elevation of the axial end 43*a* of tension roll 40 and an amount of skew thereof relative to frame 60. The positioning mechanism including belt follower 50 is located along side 60*a* of frame 60 so that only the axial end 43*a* of tension roll 40 that is coupled to tensioning arm 65 is capable of having its elevation adjusted, relative to frame 60. The opposite end of tension roll 40 does not include a belt follower for elevation adjustment. This way, the skew of tension roll 40 can be adjusted so that tracking of transfer belt 25 may be substantially reduced, thereby minimizing or substantially reducing bias related stresses on transfer belt 25 and increasing the life thereof.

The operation of the positioning mechanism will now be described in further detail with reference to FIGS. 3A-3C. The equilibrium of belt follower 50 on the angled cam surface 56 is generally influenced or affected by the weight of cleaner blade 45 indirectly contacting tension roll 40, reaction loads of tensioning arm 65, and torque from cleaner blade drag. In the position shown in FIG. 3A, transfer belt 25 is assumed to be in an initial position in which there is no belt tracking. The angled cam surface 56 extends with an increasing height from side 60*a* of frame 60 towards a central portion of tension roll 40 and belt follower 50 is shown situated in a middle portion of the angled cam surface 56. The reaction force exerted by cam 55 on belt follower 50 is sufficient to maintain belt follower 50 and tension roll 40 in their respective positions relative to a reference plane 80.

Belt follower 50 has an upper portion that is in line of engagement with an edge 26 of transfer belt 25. When belt tracking occurs in which transfer belt 25 moves laterally in a direction A1 towards belt follower 50 as depicted by 25' in FIG. 3B, edge 26 of transfer belt 25 engages and moves belt follower 50 laterally in the same direction A1 along the axis of rotation 42 of tension roll 40. As transfer belt 25 axially moves belt follower 50, belt follower 50 moves downward following the angled cam surface 56 of cam 55 and tensioning arm 65 is displaced vertically down the frame 60, thereby skewing tension roll 40 relative to reference plane 80 and reducing belt tracking. Belt follower 50 will continue to passively move along the angled cam surface 56 to change the amount of skew of tension roll 40 until a state of equilibrium is achieved in which belt follower 50 is approximately stationary relative to cam 55. In the state of equilibrium, belt follower 50 "floats" in a force balance between reaction loads of transfer belt 25, tensioning arm 65, tension roll 40, and cleaner blade 45. The reaction force exerted by cam 55 on belt follower 50 is sufficient to maintain tension roll 40 at a skew angle that reduces the lateral movement of transfer belt 25.

Figures 3A, 3B, 3C:
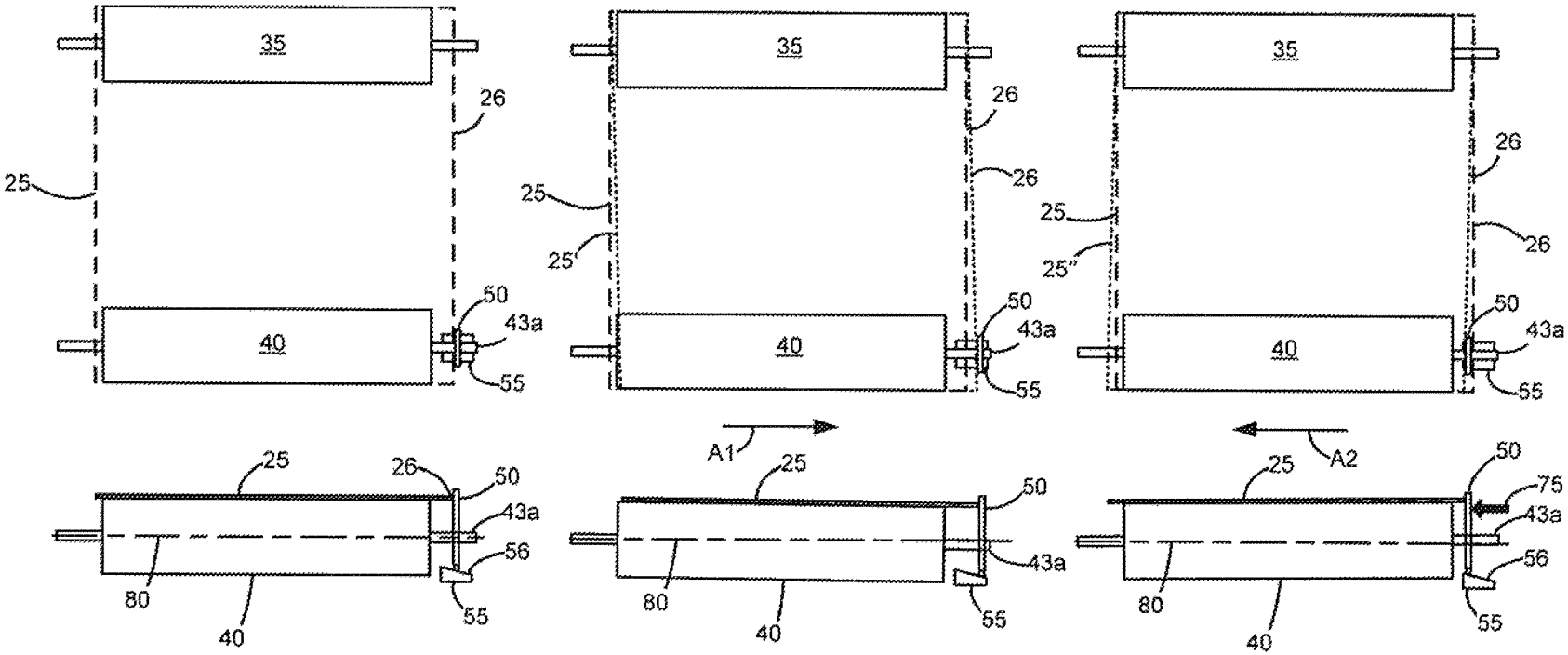
FIGS. 3A-3C are diagrammatic views showing adjustments of tension roll skew in response to belt tracking.
Figure 7:
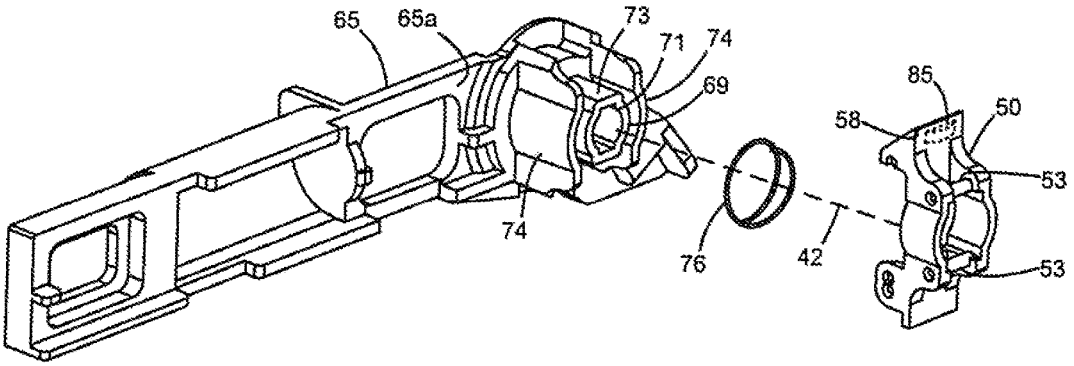
FIG. 7 is an exploded view of the assembly shown in FIG. 6.

In FIG. 3C, when transfer belt 25 nominally tracks the opposite direction A2 toward side 60*b* of frame 60 as depicted by 25", a biasing force 75 pushes belt follower 50 toward the central portion of tension roll 40 such as by the use of a compression spring 76 (FIG. 7). Belt follower 50 remains in contact with the edge 26 of transfer belt 25 as biasing force 75 continuously urges belt follower 50 against transfer belt 25. In one example, the lateral spring load of compression spring 76 is selected to provide a minimum force required on the edge 26 that is sufficient to maintain contact between belt follower 50 and transfer belt 25 as belt follower 50 moves within its range of motion along the angled cam surface 56. Because of biasing force 75, belt follower 50 follows the lateral movement of transfer belt 25 in direction A2 and moves upward following the angled cam surface 56 of cam 55, and tensioning arm 65 is displaced vertically up the frame 60 skewing tension roll 40 relative to reference plane 80 and reducing belt tracking. As before, belt follower 50 will continue to passively move along the angled cam surface 56 until a state of equilibrium is achieved.

After a state of equilibrium is achieved, belt follower 50 may passively react to balance any mechanical influences on lateral motion of transfer belt 25 by self-adjusting its position along the angled cam surface 56 to alter the skew of tension roll 40 and again establish equilibrium. With the mechanical influences of lateral belt motion balanced in this way, stresses on transfer belt 25 are reduced so as to improve belt life.

Figure 4:
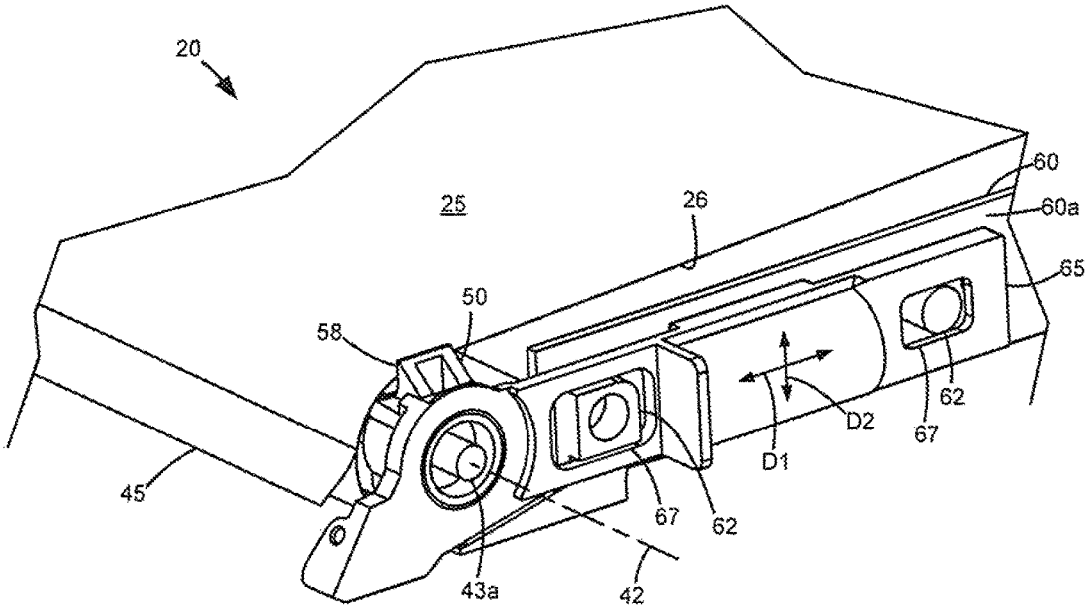
FIG. 4 is a perspective view of the adjustment mechanism according to an example embodiment.

With reference to FIGS. 4-7, an example implementation of the positioning mechanism will be described. FIG. 4 shows ITM 20 including tensioning arm 65 which couples the axial end 43*a* of tension roll 40 to side 60*a* of frame 60, transfer belt 25 with an end portion thereof wrapped around tension roll 40, and cleaner blade 45 contacting transfer belt 25 against tension roll 40. Belt follower 50 is shown coupled between tensioning arm 65 and tension roll 40 about the axial end 43*a* of tension roll 40. Tensioning arm 65 is disposed on and coupled to side 60*a* of frame 60 and is slidingly attached thereto so that tensioning arms 65, as well as the axial end 43*a* of tension roll 40, are slidable in directions D1 and D2. In the example shown, tensioning arm 65 includes slots 67, each of which is defined along a length of tensioning arm 65 and engages with a corresponding post 62 extending from side 60*a* of frame 60 to allow translation of tensioning arm 65 in directions D1 and D2 relative to frame 60.

Figure 5:
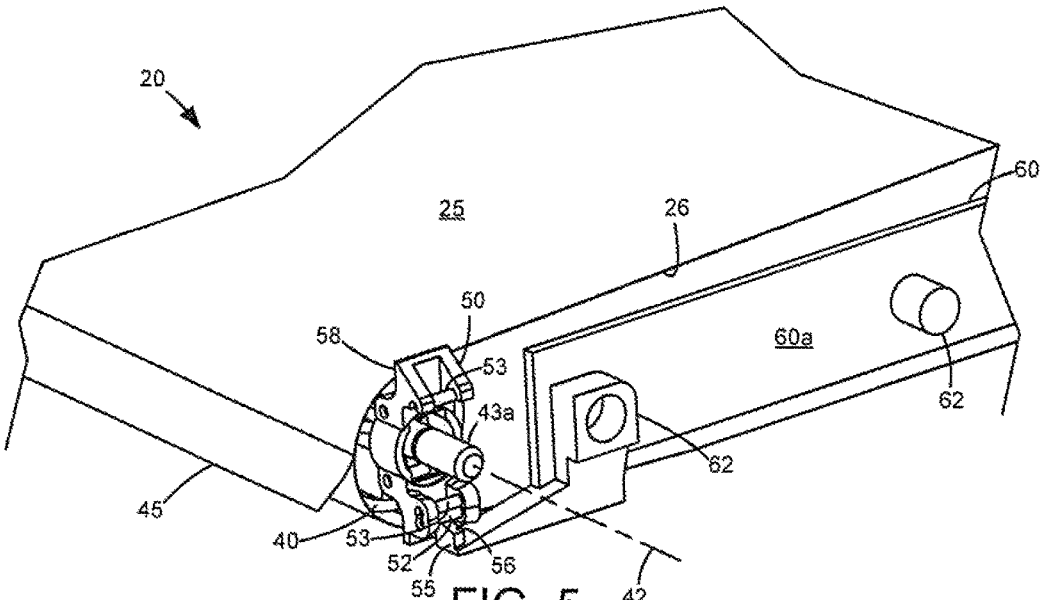
FIG. 5 is a perspective view of the adjustment mechanism in FIG. 4 exposing a belt follower and cam at an axial end of the tension roll.

In FIG. 5, tensioning arm 65 has been omitted to expose cam 55 on frame 60 and belt follower 50 at the axial end 43*a* of tension roll 40. Belt follower 50 is movable along the axis of rotation 42 of tension roll 40. In one example, belt follower 50 moves along the axis of rotation 42 within a 1 mm range at the axial end 43*a*. Cam 55 forms part of frame 60 and is disposed below belt follower 50 to provide the angled cam surface 56 along which belt follower 50 rides when it moves in the axial direction. The angled cam surface 56 has an increasing height from side 60*a* of frame 60 towards tension roll 40 such that movement of belt follower 50 away from the central portion of tension roll 40 causes belt follower 50 to move down the angled cam surface 56 and decrease the elevation of the axial end 43*a* of tension roll 40 relative to frame 60. Conversely, movement of belt follower 50 towards the central portion of tension roll 40 causes belt follower 50 to move up the angled cam surface 56 and increase the elevation of the axial end 43*a* of tension roll 40 relative to frame 60. Roller pin 52 facilitates movement of belt follower 50 along the angled cam surface 56 with reduced frictional resistance. In one example, roller pin 52 extends parallel to side 60*a* and at a length that allows it to remain in contact with the angled cam surface 56 as belt follower 50 moves together with tensioning arm 65 within its slidable range on frame 60 in direction D1.

Figure 6:
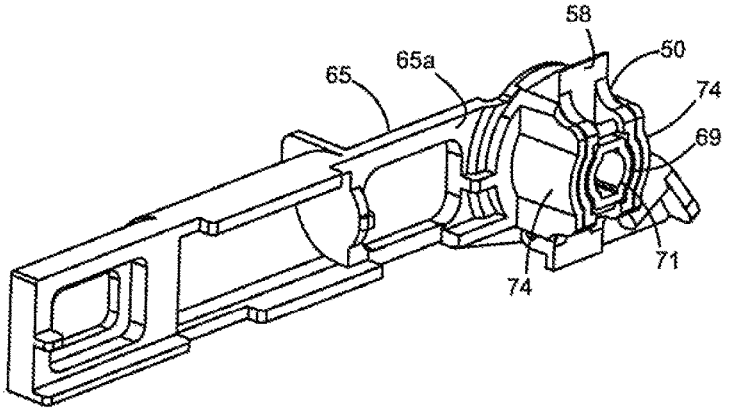
FIG. 6 is a perspective view illustrating an assembly of the belt follower and tensioning arm of the adjustment mechanism.

In FIGS. 6-7, tensioning arm 65 includes a bushing 69 protruding from an inner side 65*a* thereof. Bushing 69 has an opening 71 that receives and rotatably supports shaft end 43*a* of tension roll 40. In a further embodiment, belt follower 50 is slidably mounted along an outer surface 73 of bushing 69 and movable parallel to the axis of rotation 42 of tension roll 40. Retainers 74 also aid in securing belt follower 50 on bushing 69. To reduce frictional resistance between belt follower 50 and bushing 69, dowel pins 53 are provided on belt follower 50 at the contact points.

Belt follower 50 includes an edge guide 58 that projects beyond a top plane of transfer belt 25. Edge guide 58 serves to limit lateral motion of transfer belt 25. When transfer belt 25 moves laterally towards side 60*a* of frame 60, edge 26 of transfer belt 25 engages edge guide 58 pushing belt follower 50 towards tensioning arm 65 and down the angled cam surface 56. Edge 26 of transfer belt 25 may be a taped edge. Edge guide 58 is made from materials having relatively small coefficient of friction to reduce frictional resistance as edge 26 contacts edge guide 58 while transfer belt 25 rotates. In an alternative embodiment, a rotating member 85 (FIG. 7) may be provided at the edge guide 58 of belt follower 50 for contacting edge 26 of transfer belt 25 to reduce wear.

When transfer belt 25 moves in the opposite direction away from side 60*a* of frame 60, the biasing force provided by spring 76 disposed between tensioning arm 65 and belt follower 50 urges belt follower 50 to follow with the direction of motion of transfer belt 25 away from tensioning arm 65 and up the angled cam surface 56. In both cases after initially moving in the axial direction either up or down the angled cam surface 56, belt follower 50 self-adjusts along the angled cam surface 56 until it reaches a position that is in a state of equilibrium in which the reaction force exerted by cam 55 on belt follower 50 balances the mechanical influences on lateral motion of transfer belt 25.

The foregoing illustrates various aspects of the invention. It is not intended to be exhaustive. Rather, it is chosen to provide the best mode of the principles of operation and practical application known to the inventors so one skilled in the art can practice it without undue experimentation. All modifications and variations are contemplated within the scope of the invention as determined by the appended claims. Relatively apparent modifications include combining one or more features of one embodiment with those of another embodiment.

The invention claimed is:

1. An image transfer assembly for an electrophotographic imaging device, comprising:

a tension roll having opposed first and second axial ends;

a transfer belt having a portion extending around the tension roll such that the tension roll provides an amount of tension to the transfer belt;

a translating member slidably mounted about the second axial end of the tension roll and movable in an axial direction of the tension roll; and an angled cam disposed below the translating member such that the translating member rides on top of and along the angled cam when the translating member moves in the axial direction changing an elevation of the second axial end of the tension roll to thereby change an amount of skew between the first and second axial ends of the tension roll.

2. The image transfer assembly of claim 1, wherein the translating member includes a roller pin in contact with and movable along the angled cam.

3. The image transfer assembly of claim 1, wherein the translating member is spring-biased toward a central portion of the tension roll.

4. The image transfer assembly of claim 1, wherein the angled cam has a decreasing height in a direction from a central portion of the tension roll to the second axial end of the tension roll.

5. The image transfer assembly of claim 4, wherein the translating member moves down the angled cam when the portion of the transfer belt moves laterally towards the second axial end of the tension roll.

6. The image transfer assembly of claim 4, wherein the translating member moves up the angled cam when the portion of the transfer belt moves laterally toward the first axial end of the tension roll.

7. An image transfer assembly for an electrophotographic imaging device, comprising:

a tension roll having an axial end;

a transfer belt having a portion extending around the tension roll such that the tension roll provides an amount of tension to the transfer belt;

a movable arm operatively connected to and rotatably supporting the axial end of the tension roll;

a translating member slidably mounted about the axial end of the tension roll and movable in an axial direction of the tension roll; and an angled cam in contact with the translating member such that as the translating member moves in the axial direction, the translating member moves along the angled cam changing an elevation of the arm and the axial end of the tension roll and changing an amount of skew of the tension roll relative to a reference plane.

8. The image transfer assembly of claim 7, wherein the angled cam has a variable height in the axial direction of the tension roll.

9. The image transfer assembly of claim 7, wherein the angled cam is disposed below the translating member such that the translating member rides on top of and along the angled cam when the translating member moves in the axial direction.

10. The image transfer assembly of claim 7, wherein the translating member includes a roller pin in contact with the angled cam.

11. The image transfer assembly of claim 7, wherein the translating member is spring-biased toward a central portion of the tension roll.

12. The image transfer assembly of claim 7, further comprising a bias member disposed between the arm and the translating member, the bias member urging the translating member towards a central portion of the tension roll.

13. The image transfer assembly of claim 7, wherein the arm includes a bushing that receives and rotatably supports the axial end of the tension roll, the translating member being slidably mounted around the bushing.

14. A skew adjustment mechanism for an image transfer assembly having a backup roll, a tension roll, and a transfer belt formed as an endless loop around the backup roll and the tension roll, comprising:

a movable arm operatively connected to and rotatably supporting an axial end of the tension roll;

a translating member slidably mounted about the axial end of the tension roll and movable in an axial direction of the tension roll; and an angled cam in contact with the translating member such that as the translating member moves in the axial direction, the translating member moves along the angled cam changing an elevation of the arm and the axial end of the tension roll and changing an amount of skew of the tension roll relative to a reference plane.

15. The skew adjustment mechanism of claim 14, wherein the angled cam is disposed below the translating member such that the translating member rides on top of and along the angled cam when the translating member moves in the axial direction.

16. The skew adjustment mechanism of claim 14, wherein the translating member includes a roller pin in contact with the angled cam.

17. The skew adjustment mechanism of claim 14, wherein the translating member is spring-biased toward a central portion of the tension roll.

18. The skew adjustment mechanism of claim 14, wherein the angled cam has a decreasing height in a direction from a central portion of the tension roll to the axial end of the tension roll.

19. The skew adjustment mechanism of claim 18, wherein the translating member moves down the angled cam when the transfer belt moves laterally toward the axial end of the tension roll.

20. The skew adjustment mechanism of claim 18, wherein the translating member moves up the angled cam when the transfer belt moves laterally away from the axial end of the tension roll.

* * * * *